US005438971A

United States Patent [19]

Murata et al.

[11] Patent Number: 5,438,971

[45] Date of Patent: Aug. 8, 1995

[54] IGNITION COIL DEVICE FOR AN INTERNAL COMBUSTION ENGINE

[75] Inventors: Shigemi Murata; Nobuyuki Sawazaki; Mitsuru Koiwa; Yutaka Ohashi, all of Himeji, Japan

[73] Assignee: Mitsubishi Denki Kabushiki Kaisha, Tokyo, Japan

[21] Appl. No.: 165,912

[22] Filed: Dec. 14, 1993

[30] Foreign Application Priority Data

Jul. 9, 1993 [JP] Japan ..... 5-169977

[51] Int. Cl.[6] ..... H01F 3/00; F02P 3/02

[52] U.S. Cl. ..... 123/634; 123/635; 123/647

[58] Field of Search ..... 123/634, 635, 644, 647, 123/649

[56] References Cited

U.S. PATENT DOCUMENTS

| | | | |
|---|---|---|---|
| 4,248,201 | 2/1981 | Tsutsui et al. | 123/647 |
| 4,567,874 | 2/1986 | Rouanes | 123/634 |
| 4,825,844 | 5/1989 | Fasola | 123/635 |
| 4,951,641 | 8/1990 | Takaishi et al. | 123/634 |
| 5,170,768 | 12/1992 | Eileraas | 123/634 |
| 5,172,302 | 12/1992 | Taruya et al. | 361/386 |
| 5,239,973 | 8/1993 | Murata et al. | 123/635 |
| 5,257,611 | 11/1993 | Chapekis et al. | 123/634 |

FOREIGN PATENT DOCUMENTS 5-87034 of 1993 Japan .

*Primary Examiner*—Thomas N. Moulis
*Attorney, Agent, or Firm*—Sughrue, Mion, Zinn, Macpeak & Seas

[57] ABSTRACT

An ignition coil device for an internal combustion engine comprising: a plurality of iron cores; a plurality of ignition coils having a plurality of primary coils provided around said plurality of iron cores and a plurality of secondary coils magnetically-coupled with said plurality of primary coils through the plurality of iron cores; a case accommodating the plurality of iron cores and the plurality of ignition coils; and a plurality of control units accommodated in said case of which number is equal to the number of the plurality of ignition coils.

6 Claims, 4 Drawing Sheets

IGNITION COIL DEVICE FOR AN INTERNAL COMBUSTION ENGINE

BACKGROUND OF THE INVENTION

1. Field of the Invention

This invention relates to an ignition coil device for an internal combustion engine which supplies high voltage to ignition plugs for an internal combustion engine.

2. Discussion of Background

FIG. 5 is a diagram showing the construction of an ignition coil device and a control unit, wherein reference numeral 1 designates an ignition coil device having three sets of ignition coils 1*a*, reference numeral 2 represents a control unit having three sets of power transistors 21 for interrupting primary current to the ignition coils 1*a* and three sets of current flowing time setting circuits 22 for controlling the power transistors 21, reference numeral 3 represents lead wires for electrically connecting the ignition coil device 1 and the control unit 2, and numeral 4 designates ignition plugs mounted on respective cylinders (6 cylinders) for an internal combustion engine, not shown.

In the above construction, first, primary current flows in the ignition coil 1*a* by switching on the power transistor 21 by the current flowing time setting circuit 22 at a predetermined starting time. Next, the power transistor 21 is switched off by the current flowing time setting circuit 22 at a predetermined ignition timing thereby cutting off the primary current in the ignition coil 1*a*. At this moment, high voltage is generated on the secondary side of the ignition coil 1*a*, the high voltage is supplied to the ignition plug, and a mixture in a cylinder, not shown, is ignited.

The conventional ignition coil device and control unit are constructed as above, wherein the ignition coil device 1 and the control unit 2 are separately installed. Accordingly, it is necessary to connect the ignition coil device 1 and the control unit 2 through the lead wires 3, and therefore, the lead wires 3, terminals or connectors for connecting the lead wires 3 and the ignition coils 1, and terminals or connectors for connecting the lead wires 3 and the control unit 2 are necessary. Hence, there is a problem in the conventional technology, wherein the number of parts is large, the construction is complicated, and the device is devoid of the mounting performance to an engine or the like. Further, many kinds of control units are necessary for corresponding to internal combustion engines having different number of cylinders, detracting from general purpose use.

SUMMARY OF THE INVENTION

It is an object of the present invention to solve the above problems and to provide an ignition coil device for an internal combustion engine of which construction is simple and which is excellent in the mounting performance to an engine or the like.

According to a first aspect of the present invention, there is provided an ignition coil device for an internal combustion engine comprising:

a plurality of iron cores;

a plurality of ignition coils having a plurality of primary coils provided around said plurality of iron cores and a plurality of secondary coils magnetically-coupled with said plurality of primary coils through the plurality of iron cores;

a case accommodating the plurality of iron cores and the plurality of ignition coils; and a plurality of control units accommodated in said case of which number is equal to the number of the plurality of ignition coils.

According to a second aspect of the present invention, there is provided an ignition coil device for an internal combustion engine according to the first aspect, wherein the plurality of control units are fixed to a heat sink for radiating heat composed of a metallic material.

According to a third aspect of the present invention, there is provided an ignition coil device for an internal combustion engine according to the second aspect, wherein the heat sink for radiating heat forms a portion of the case accommodating a plurality of coil units.

According to a fourth aspect of the present invention, there is provided an ignition coil device for an internal combustion engine according to the second aspect, wherein a portion of the heat sink for radiating heat is installed on a face for attaching the ignition coil device and said portion of the heat sink contacts an attaching member.

According to a fifth aspect of the present invention, there is provided an ignition coil device for an internal combustion engine according to the first aspect, wherein the plurality of control units are respectively sealed in a solid by a resin before accommodating the plurality of control units in the case.

According to a sixth aspect of the present invention, there is provided an ignition coil device for an internal combustion engine according to the first aspect, wherein an ignition detecting circuit performing an ignition detection by detecting a primary voltage or a primary current of the plurality of ignition coils is accommodated in the case or attached to a portion of the case.

According to the first aspect of the invention of the ignition coil device for an internal combustion engine, its construction is simple and the mounting to an engine or the like is facilitated, since the control unit is accommodated in the case which is shared by the ignition coils.

According to the second aspect of the invention of the ignition coil device for an internal combustion engine, the heat irradiating performance of the control unit is very much improved by the heat sink for radiating heat.

According to the third aspect of the invention of the ignition coil device for an internal combustion engine, the construction can be further simplified and downsized since the heat sink for radiating heat forms a portion of the case.

According to the fourth aspect of the invention of the ignition coil device for an internal combustion engine, the heat radiating performance can be further improved, since a portion of the heat sink contacts the attaching member.

According to the fifth aspect of the invention of the ignition coil device for an internal combustion engine, the general purpose use of the control unit is very much improved, since the plurality of control units are respectively solid-sealed by a resin.

According to the sixth aspect of the invention of the ignition coil device for an internal combustion engine, the construction is simplified and the mounting to an engine or the like is facilitated, since the ignition detecting circuit is accommodated in the case, or attached to a portion of the case.

DETAILED DESCRIPTION OF THE PREFERRED EMBODIMENTS

EXAMPLE 1

Figure 1A:
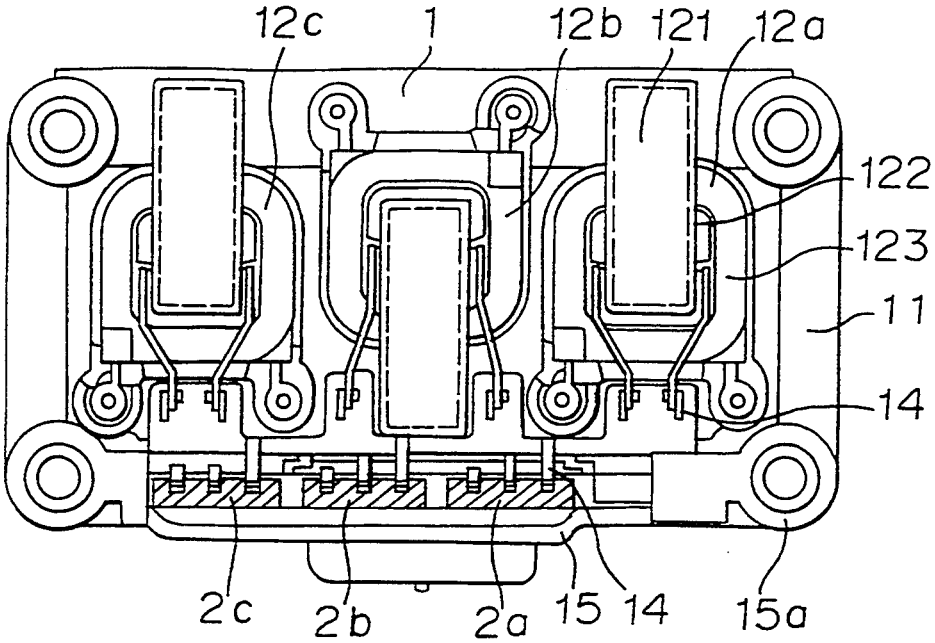
FIGS. 1(*a*) and 1(*b*) are diagrams showing an example of an ignition coil device for an internal combustion engine, wherein FIG. 1(*a*) is a front diagram and 1(*g*), a sectional plane view.
Figure 1B:
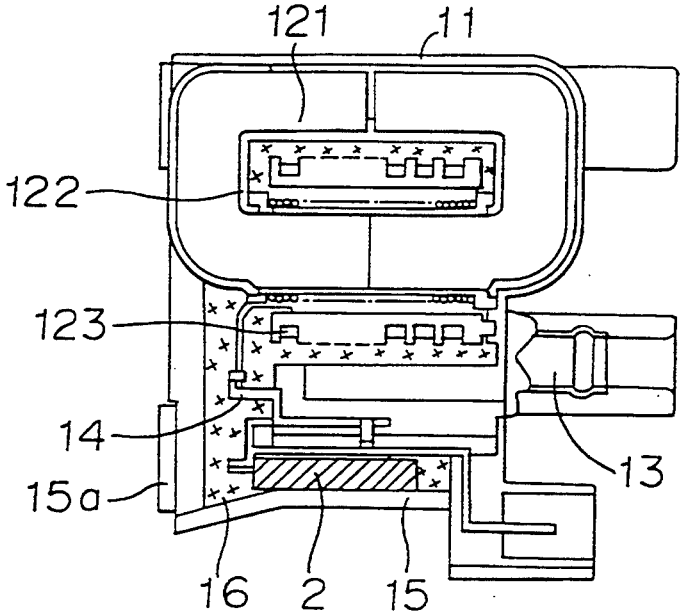

An explanation will be given of an Example of this invention in reference to FIGS. 1(*a*), 1(*b*) and 2 as follows. In FIGS. 1(*a*) and 1(*b*), reference numeral 11 designates a case wherein three sets of ignition coils 12*a*, 12*b* and 12*c*, and control units 2*a*, 2*b* and 2*c* for controlling primary current of the ignition coils 12*a*, 12*b* and 12*c* are accommodated. The respective ignition coils 12*a*, 12*b* and 12*c* are composed of iron cores 121, primary coils 122 wound around the iron cores, and secondary coils 123 wound around the primary coils 122 and magnetically-coupled with the primary coils through the iron cores 121. Both ends of the secondary coils 123 are connected to high voltage terminals 13, and high voltage is introduced to ignition-plugs of the respective cylinders for an internal combustion engine through high voltage cables, not shown. Both ends of each primary coil 122 are respectively connected to terminals 14 which are insert-formed in the case 11, one of which is connected to the control unit 2 through the terminal 14, and the other of which is connected to a battery 5 through the terminal 14 and an outer lead wire, not shown. The respective control units 2*a*, 2*b* and 2*c* are fixed to a heat sink 15 which forms a portion of the case 11 and which is composed of a metallic material having good thermal conductivity, such as aluminum, by screws, not shown. The heat generated at the power transistors inside the control unit 2 for switching the primary current, is radiated to the outer atmosphere through the heat sink 15, since a face of the heat sink 15 is exposed to the outer atmosphere. Further, a portion of the heat sink 15 is arranged at an attaching face 15*a*. Accordingly, when the device is attached to an internal combustion engine, efficient heat radiation is performed by contacting the attaching face 15*a* directly to the internal combustion engine or the like. Epoxy resin 16 is filled in the case 11, thereby insulating and fixing the respective parts in the case.

Further, the respective control units 2*a*, 2*b* and 2*c* are solid-sealed by a resin, and the same control units are employed with respect to a device corresponding to internal combustion engines having different number of cylinders.

Figure 2:
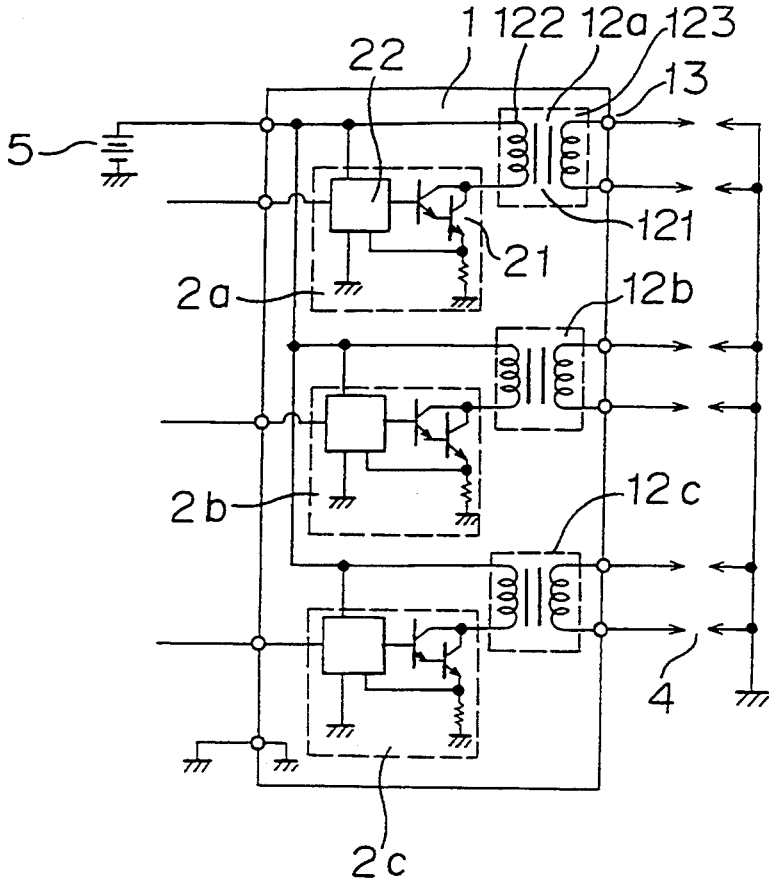
FIG. 2 is a circuit diagram showing electrical connections for the example of FIG. 1(*a*) of the ignition coil device for an internal combustion engine.

FIG. 2 shows an electrical inner connecting state and outer connecting state of the device. In FIG. 2, the respective control units 2*a*, 2*b* and 2*c* are composed of current flowing time setting circuits 22 respectively including signal amplifying circuits, current limiting circuits and the like, and the power transistors 21. Signals whereby the ignition timing and current flowing time are controlled, are inputted from a control unit, not shown, to the current flowing time setting circuits 22 and the power transistors 21 perform switching operation based on the signals. The collectors of the power transistors 21 are connected to ends of the respective primary coils 122 of the ignition coils 12*a*, 12*b* and 12*c* corresponding to the respective control units 2*a*, 2*b* and 2*c*, at the inside of the device. The other ends of the primary coils 122 are connected to the battery 5 through an outer wiring, wherein three sets of the ignition coils are commonly connected inside of the device. Both ends of the secondary coils 123 of the respective ignition coils are connected to the high voltage terminals 113 and connected to the ignition plugs 4 of the respective cylinders through the high voltage cables.

With respect to the device constructed as above, since the control units are accommodated in the case which is shared by the ignition coils, the construction is simple and the mounting to an engine or the like is facilitated.

Further, since the heat sink for radiating heat composes a portion of the case, and contacts the attaching member, the construction is simplified and downsized and yet the heat radiating performance of the control unit is very much improved.

Further, since the plurality of control units are respectively solid-sealed by a resin, the general purpose use of the control unit is very much promoted.

EXAMPLE 2

Figure 3A:
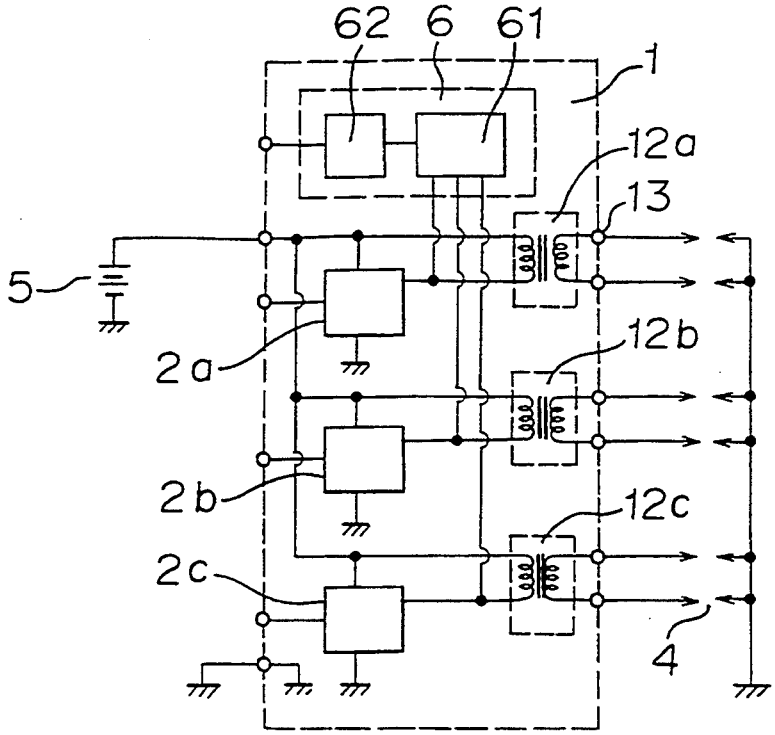
FIGS. 3(*a*) and 3(*b*) are circuit diagrams showing the electrical connections of other examples of this invention of ignition coil devices for an internal combustion engine.
Figure 3B:
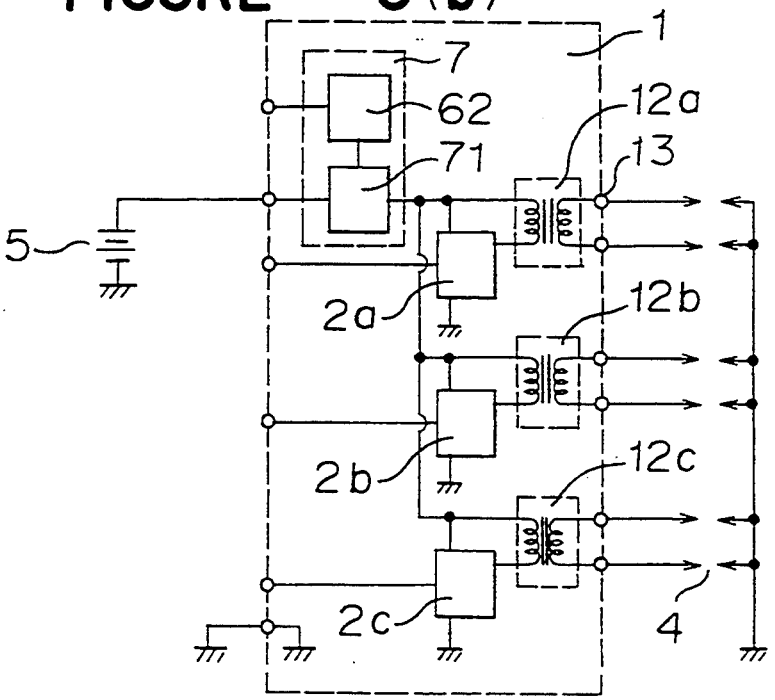

FIGS. 3(*a*) and 3(*b*) show the inner construction of an Example wherein also an ignition detecting circuit for detecting a primary voltage or a primary current and outputting an ignition detecting signal, is incorporated. In FIG. 3(*a*), numeral 6 designates an ignition detecting circuit operated by the detecting of the primary voltage, which is composed of a voltage detecting circuit 61 and a pulse outputting circuit 62. A pulse is outputted when the primary voltage which is led from the respective junctions of the power transistors 21 and the primary coils 122 inside of the control unit 2, reaches a predetermined value. In FIG. 3(*b*), numeral 7 designates an ignition detecting circuit operated by the detection of the primary current, which is composed of a current detecting circuit 71 and the pulse outputting circuit 62. The current flowing from the battery 5 to the respective primary coil is detected by a common power source line, and a pulse is outputted when the current value is not less than a predetermined value.

Figure 4:
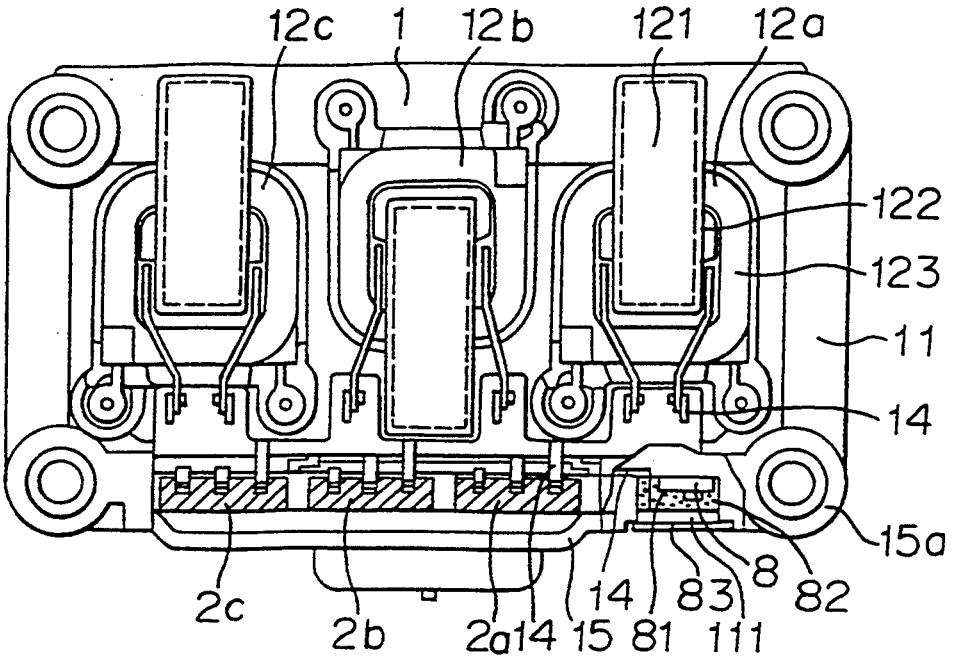
FIG. 4 is a block diagram showing the examples shown in FIGS. 3(*a*) and 3(*b*) of the ignition coil devices for an internal combustion engine.
Figure 5:
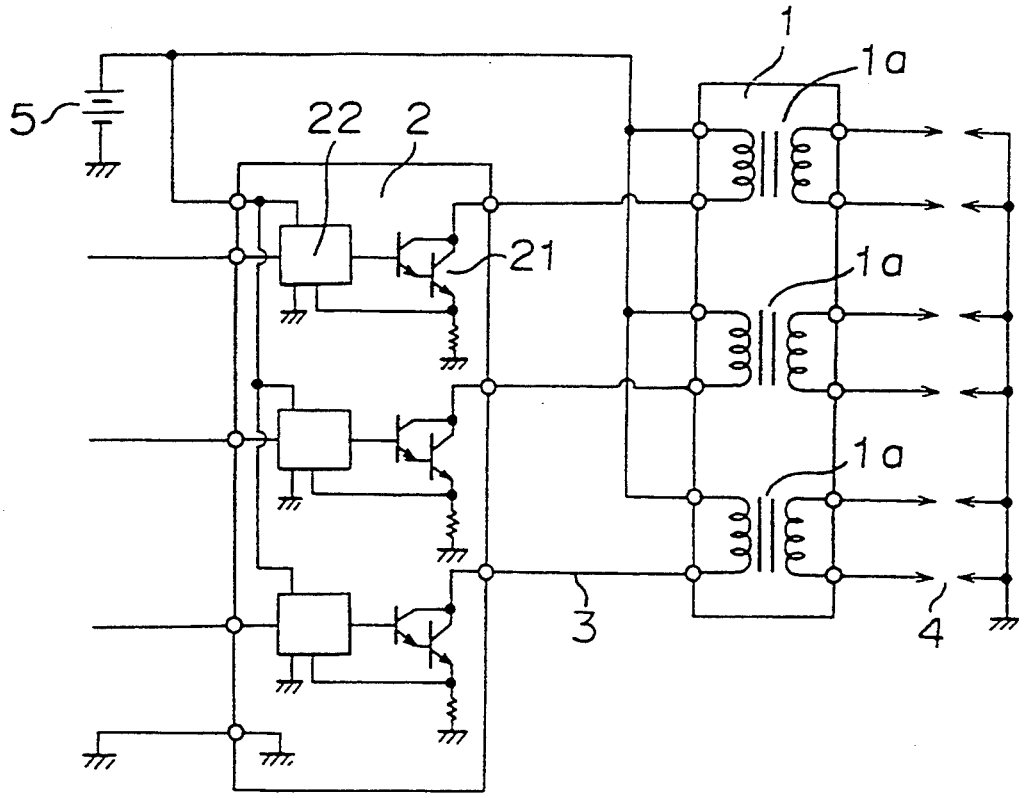
FIGURE 5 PRIOR ART
FIG. 5 is a circuit diagram showing the electrical connections of a conventional ignition coil device for an internal combustion engine.

FIG. 4 shows an Example of construction wherein the ignition detecting circuit is incorporated in the device. An accommodating unit 111 is provided at the portion of the case 11, wherein a hybrid IC8 of the ignition detecting circuit is installed. A lead 81 coming out of the hybrid IC8 is connected to the terminal 14 which is insert-formed in the case and is arranged as shown in FIG. 3(*a*) or 3(*b*). A hybrid IC accommodating unit 111 is sealed by a cover 83 after filling a resin 82 such as silicone gel on the hybrid IC.

In the above construction, the ignition detecting circuit is accommodated in the case, or attached to a portion of the case, and therefore, the construction is simplified and the mounting to an engine or the like is further facilitated.

EXAMPLE 3

In the above Examples, explanation has been given to cases wherein three sets of the ignition coils and three sets of the control units are accommodated in the single case. However, this invention is not limited to three sets of these. Naturally, no restriction is required for the number of these, so far as the numbers are plural.

As explained above, according to the first aspect of the invention of the ignition coil device for an internal combustion engine, the invention is provided with an effect wherein the construction is simplified and the mounting to an engine or the like is facilitated, since the control units and the ignition coils share the same case.

According to the second aspect of the invention of the ignition coil device for an internal combustion engine, the invention is provided with an effect wherein the heat radiating performance of the control unit is very much improved by the heat sink for radiating heat.

According to the third aspect of the invention of the ignition coil device for an internal combustion engine, the invention is provided with an effect wherein the construction is more simplified and downsized, since the heat sink for radiating heat forms a portion of the case.

According to the fourth aspect of the invention of the ignition coil device for an internal combustion engine, the invention is provided with an effect wherein the heat radiating performance is more improved, since a portion of the heat sink contacts the attaching member.

According to the fifth aspect to he invention of the ignition coil device for an internal combustion engine, the invention is provided with an effect wherein the general purpose use of the control unit is very much promoted, since the plurality of control unit are respectively solid-sealed.

According to the sixth aspect of the invention of the ignition coil device for an internal combustion engine, the invention is provided with an effect wherein the construction is simplified and the mounting to an engine or the like is facilitated, since the ignition detecting circuit is accommodated in the case, or attached to a portion of the case.

What is claimed is:

1. An ignition coil device for an internal combustion engine comprising:

a plurality of iron cores;

a plurality of ignition coils having a plurality of primary coils provided around said plurality of iron cores and a plurality of secondary coils magnetically-coupled with said plurality of primary coils through the plurality of iron cores;

a single case accommodating the plurality of iron cores and the plurality of ignition coils; and a plurality of control units, each including a current flow control circuit, accommodated in said case of which number is equal to the number of the plurality of ignition coils.

2. The ignition coil device for an internal combustion engine according to claim 1, wherein the plurality of control units are fixed to a heat sink for radiating heat composed of a metallic material.

3. The ignition coil device for an internal combustion engine according to claim 2, wherein the heat sink for radiating heat forms a portion of the case accommodating a plurality of coil units.

4. The ignition coil device for an internal combustion engine according to claim 2, wherein a portion of the heat sink for radiating heat is installed on a mounting member of the ignition coil device, so that heat is drawn out of the ignition coil device through the mounting member.

5. The ignition coil device for an internal combustion engine according to claim 1, wherein the plurality of control units are respectively sealed in a solid by a resin before accommodating the plurality of control units in the case.

6. The ignition coil device for an internal combustion engine according to claim 1, wherein an ignition detecting circuit performing an ignition detection by detecting a primary voltage or a primary current of the plurality of ignition coils is accommodated in the case or attached to a portion of the case.

* * * * *